United States Patent [19]

Pope

[11] 4,040,628

[45] Aug. 9, 1977

[54] DIETING GAME BOARD APPARATUS

[76] Inventor: Isaac Louis Pope, 5 Ben Yehuda Str., Netanya, Israel

[21] Appl. No.: 659,265

[22] Filed: Feb. 19, 1976

[51] Int. Cl.[2] ..... A63F 3/00

[52] U.S. Cl. ..... 273/134 B; 273/134 C; 273/134 D; 273/134 AT

[58] Field of Search ..... 273/134

[56] References Cited

U.S. PATENT DOCUMENTS

| | | | |
|---|---|---|---|
| 2,273,292 | 2/1942 | Smith | 273/134 AC |
| 3,659,852 | 5/1972 | Redict | 273/134 AD |
| 3,737,167 | 6/1973 | Kelley | 273/134 C |
| 3,889,954 | 6/1975 | Malison | 273/134 C |

*Primary Examiner*—Delbert B. Lowe

[57] ABSTRACT

Dieting game board apparatus adapted to be played by a plurality of players operating in turn. The apparatus comprises a combination of a chance generating device, a plurality of playing pieces each representing a dieter, weight change indicating apparatus corresponding to each playing piece and functioning as a scoring device, and a flat playing board having a playing surface defined on a base surface thereof. A series of playing locations are defined about the perimeter of the playing surface in substantially contiguous relationship comprising a playing path along which the playing pieces are moved in discrete steps between successive locations as indicated by the chance generating device. The series of playing locations includes a first plurality of locations indicating that a player whose piece lands thereon is to gain weight and a second plurality of locations indicating that a player whose piece lands thereon is to lose weight.

7 Claims, 3 Drawing Figures

Fig. 1

DIETING GAME BOARD APPARATUS

FIELD OF THE INVENTION

The present invention relates to board games and more particularly to educational board games which may be played by persons of varying ages and which have the combined purposes of providing entertainment and of introducing and reinforcing normative values.

BACKGROUND AND SUMMARY

There are known in the art a large variety of board games bases on and directed to various situations, such as financial games, athletic games, inventive games, etc. The present game is directed to dieting, a concern and a preoccupation of a significant minority of the population which is overweight. In addition to emphasizing positive and negative steps which may be taken in conjunction with dieting, as a solution to problems of overweight, the game places particular emphasis on a preferred relatively slow and steady approach at opposed to a crash diet approach. This emphasis is effected both in the rules and in the results of playing the game.

In accordance with the present invention there is provided dieting game board apparatus adapted to be played by a plurality of players operating in turn, the apparatus comprising a combination of:

chance generating means;

a plurality of playing pieces each representing a dieter;

weight recording means corresponding to each playing piece and functioning as a scoring device;

a playing board having a playing surface defined on a base surface thereof;

a series of playing locations defined about the perimeter of said playing surface in substantially contiguous relationship comprising a playing path along which said playing pieces are moved in discrete steps between successive locations, as indicated by said chance generating means, said series of playing locations comprising:

a first plurality of locations indicating that a player whose piece lands thereon is to gain weight; and a secnd plurality of locations indicating that a player whose piece land thereon is to lose weight.

In accordance with a preferred embodiment of the present invention there is provided a dieting game board apparatus adapted to be played by a plurality of players operating in turn, the apparatus comprising a combination of:

chance generating means;

a plurality of playing pieces, each representing a dieter;

weight recording means corresponding to each playing piece and functioning as a scoring device;

a supply of game money initially distributed at least in part of each player;

a plurality of weight cards containing player directions;

a flat generally rectangular shaped playing board having a playing surface defined on a base surface thereof;

a series of playing locations defined about the perimeter of said playing surface in substantially contiguous relationship to define a playing path along which said playing pieces are moved in discrete steps between successive locations as indicating by said chance generating means, the series of playing locations comprising:

at least one location providing an electable opportunity to a player whose piece lands thereon to lose a relatively large amount of weight in return for payment of a relatively large amount of game money;

at least one location indicating that a player whose piece lands thereon is to gain a relatively small amount of weight in return for an amount of money;

at least one location which indicates that a player whose piece lands thereon is to lose a relatively small amount of weight in return for a relatively small amount of money;

at least one location which indicates that a player whose piece lands thereon is to gain a relatively small amount of weight;

at least one location which indicates that a player whose piece lands thereon is to take one of the weight cards and to be directed by the directions contained thereon.

In accordance with a further preferred embodiment of the invention the playing pieces, weight recording means and playing board are constructed in a manner such as to associate the game apparatus with a player's dieting experience and the accouterments thereof.

BRIEF DESCRIPTION OF THE DRAWINGS

The invention will be more fully understood and appreciated from the following detailed description of a preferred embodiment thereof taken in conjunction with the drawings in which.

DETAILED DESCRIPTION OF THE INVENTION

Figure 1:
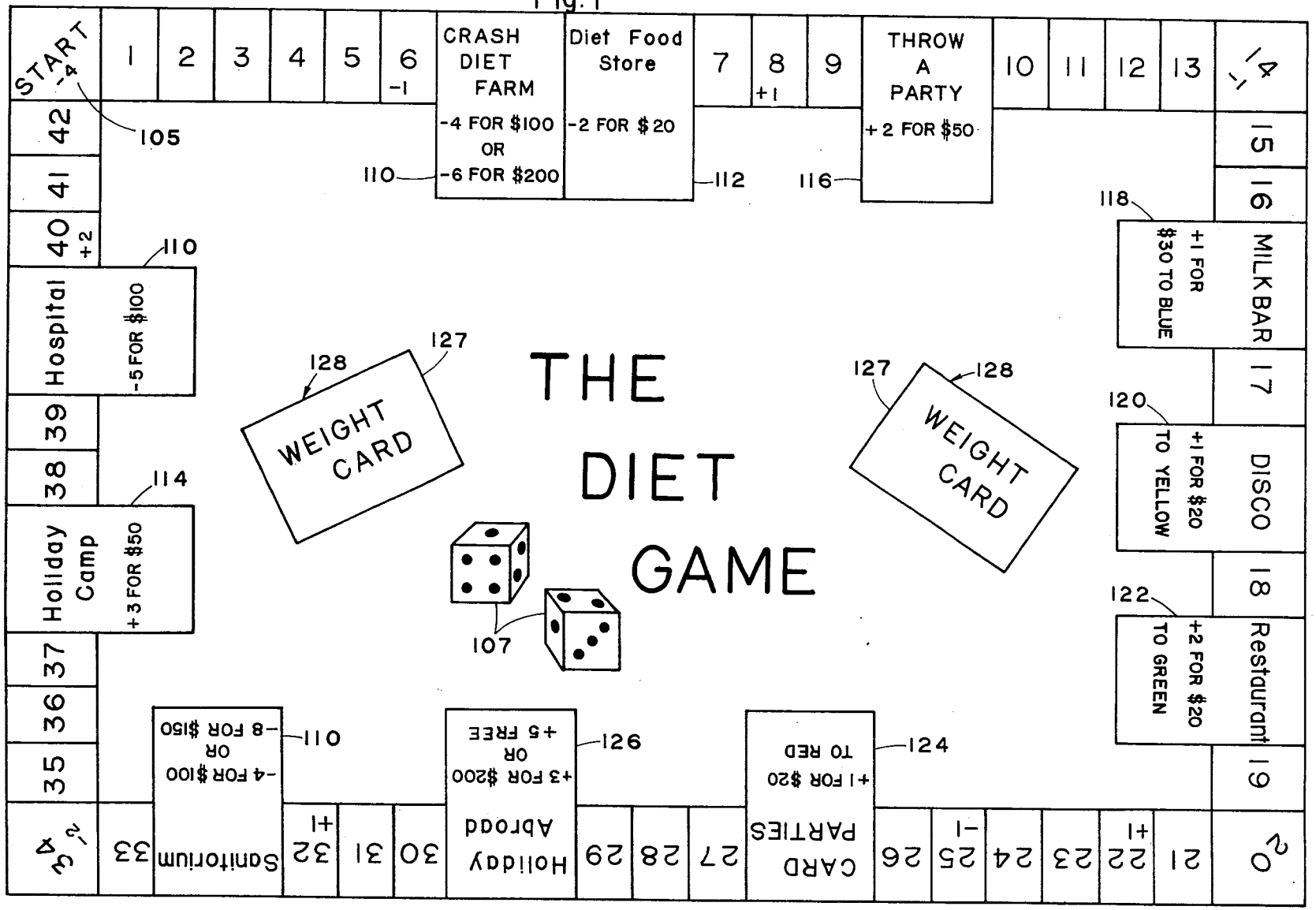
FIG. 1 shows a playing board and associated apparatus constructed in accordance with a preferred embodiment of the invention.

Referring now to the drawings it is noted that the drawings and the descriptions thereof which follow are merely intended to be exemplary of preferred embodiments of the invention and are not intended to be exhaustive of the possibilities of games or types of games within the intended scope of the invention.

Referring now to FIG. 1 there is shown a playing board for a diet game constructed in accordance with an embodiment of the invention to have a playing surface defined on a base surface thereof and containing a plurality of playing locations disposed contiguously along the periphery of the playing surface.

Figure 2B:
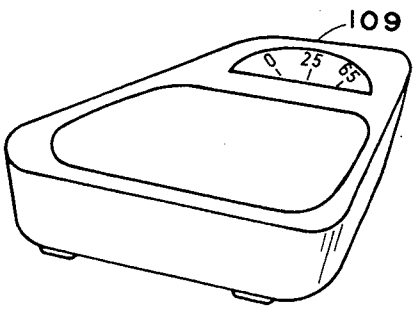
FIG. 2*b* shows simulated weight recording apparatus constructed in accordance with an embodiment of the invention and usable together with the game board of FIG. 1.
Figure 2A:
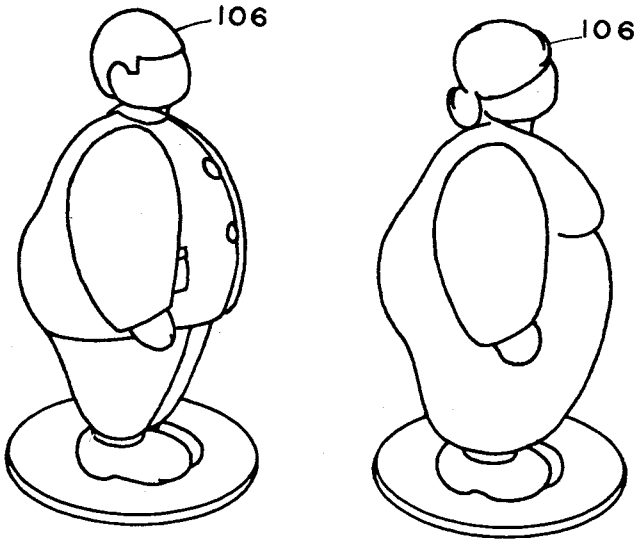
FIG. 2*a* shows playing pieces constructed according to a preferred embodiment of the invention and usable in conjunction with the playing board shown in FIG. 1.

Referring additionally to FIG. 2A typical playing pieces 106 are seen in pictorial illustration larger than their actual size. To enhance the enjoyment of the game, the playing pieces are configured to resemble overweight persons and, for the purposes of the game, as will be described hereinafter, the playing pieces are identified each by a separate dominant color to which reference is made both on the playing board and in the rules of the game. In a typical embodiment of the invention suitable for playing by four participants, four playing pieces 106 are provided and may be identified by the colors blue, red, green and yellow, for example, Chance genrating mens, typically a pair of conventional dice 107, shown in FIG. 1 but not forming part of the playing board, are provided for determining the players' moves. Each player is also provided with a miniature bathroom scale 109 (FIG. 2B) as a scoring device. Scoring using the scale will be explaned hereinafter.

In the embodiment of the invention illustrated in FIG. 1 there are provided a start location 105 and 42 rectangular numbered locations including three square corner locations, the remaining locations being generally of the same size. Of the 42 numbered locations, fifteen are designated with particular colors which are related to the identifying colors of the playing pieces by the game rules, as will be described in greater detail hereinafter. The color identifications are listed below:

| Location Number | Color |
|---|---|
| 1 | Red |
| 2 | Blue |
| 3 | Green |
| 4 | Yellow |
| 9 | Red |
| 12 | Yellow |
| 16 | Green |
| 17 | Red |
| 18 | Blue |
| 26 | Blue |
| 27 | Yellow |
| 31 | Green |
| 33 | Yellow |
| 36 | Red |
| 38 | Blue |

Many of the numbered locations also contain instructions to a participant whose playing pieces lands on the numbered location. An examplary listing of a set of suitable instructions is provided hereinbelow:

| Location number | Instruction |
|---|---|
| 5 | Take a weight card. |
| 6 | You have a strong character. Lose 1 lb. |
| 7 | Take a weight card. |
| 8 | Stop going to the fridge. Add 1 lb. |
| 10 | Buy some new clothes. Spend $100. |
| 11 | Take a weight card. |
| 13 | Take a weight card. |
| 14 | You are doing well this week. Lose 1 lb. |
| 15 | Sell some old clothes. Earn $50. |
| 19 | Take a weight card. |
| 20 | Spend $10 on a diet publication. |
| 21 | Start again. Go back to start. |
| 22 | What ... another hangover!Add 1 lb. |
| 23 | Take a weight card. |
| 24 | Stop worrying. You look marvellous. |
| 25 | Get off the scale. You have lost 1 lb. |
| 28 | Take a taxi to location 13. |
| 29 | Alter your clothes. Spend $30. |
| 30 | Take a weight card. |
| 32 | Stop eating in between meals. |
| | You put on 1 lb. |
| 34 | Start a fresh diet and lose 2 lbs. |
| 35 | Don't think about food all the time. |
| 37 | Draw $50 from the bank. |
| 39 | Take a weight card. |
| 40 | Put those chocolates down. Add 2 lbs. |
| 41 | Go to a holiday camp. |
| 42 | Go to the diet food store. |

The start location 105 bears the following instructions: Collect $200 and lose 4 lbs. when you pass here.

Interspersed among the numbered locations are a first plurality of large playing locations each identified by the reference numeral 110 and each providing one or more electable opportunities to a player whose playing piece lands thereon to lose a relatively large amount of weight in return for a relatively large amount of game money. Included in this first plurality of locations are locations identified as follows:

Sanatorium which offers a weight loss of 4lbs for payment of $100, and a weight loss of 8 lbs. for payment of $150;

Hospital which offers a weight loss of 5 lbs. for payment of $100; and

Crash diet farm which offers a weight loss of 4 lbs. for payment of $100 and 6 lbs. for payment of $200.

The game is designed such that players who elect not to take advantage of the high-priced weight loss offered at locations 110 tend to be more successful than those who prefer the quick-loss high-cost formula.

Also interspersed among the numbered locations is a location 112 identified as a Diet Food Store which requires payment of $20 and indicates a weight loss of 2 lbs. There is also provided a location 114 identified as Holiday Camp which requires a payment of $50 and indicates a weight gain of 3 lbs.

Location 116 identified as THROW A PARTY requires a payment of $50 and indicates a weight gain of 2 lbs. for all of the participants except the one whose piece lands on the location. Location 118, identified as MILK BAR, indicates a weight gain of 1 lbs. and requires a payment of $30 to the blue participant. Location 120 labelled DISCO also indicates a weight gain of 1 lb. and requires the participant whose piece lands thereon to pay $20 to the yellow participant. Location 122 set aside as RESTAURANT indicates a weight gain of 2 lbs. and requires the participant whose piece lands thereon to pay $20 to the green participant. Location 124 identified as CARD PARTIES indicates a weight gain of 1 lb. and requires the participant whose piece lands thereon to pay the red participant $20. Location 126 identified as HOLIDAY ABROAD provides the participant whose piece lands theron selectable choice of two options. The first option is to pay $200 for a fortnight 's holiday and to put on 3 lbs. The other option is to pay nothing and to put on 5 lbs.

There is also provided a plurality of weight cards 127 which are normally maintained in a face down shuffled condition in either one or both of the blocks 128 on the playing surface. The wieght cards bear the following legends:

WEIGHT CARDS

1. It's a beautiful day for a picnic in the country-side. Add 1 pound.
2. You feel the need for supervision when dieting. Go to the Sanitorium today. Do not pass Start.
3. You are feeling the pangs or hunger. Drop in at your favourite Restaurant for lunch.
4. You have lost one pound.
5. If you have paid a visit to the CRASH DIET FARM, or the HOSPITAL, or SANITORIUM - add 4 lbs.
6. You think that you would prefer medical supervision while dieting. Go to the hospital. Do not pass Start.
7. You have stopped eating between meals. Lose one pound.
8. Your dieting is under control. Lose one pound.
9. You want to celebrate this evening. Go to the DISCOTHEQUE as usual.
10. Add two pounds if you have undergone an intensive diet for a week. If for 2 weeks, add 4 pounds.
11. You have had a windfall. Receive $50 from the bank.
12. Stop going to the 'frig so often. Put on 1 pound.

13. Did you visit the SANITORIUM or CRASH DIET FARM or HOSPITAL for a week? Then add three pounds. If you were at one of these places for a fortnight — add 5 pounds.
14. You are refusing to eat all the wrong foods. Lose 2 pounds
15. Stop eating between meals. Put on 1 pound this week.
16. You can't cheat the scales. Put on one pound.
17. What another hangover! Put on 1 pound.
18. Go to Square 5 today
19. Add 2 pounds if you have undergone an intensive diet for a week. If for two weeks, add 4 pounds.
20. Add 2 pounds if you have undergone an intensive diet for a week. If for two weeks, add 4 pounds.

Conventional game money in dollar denomination for use in playing the game is provided. Some of it is divided amongst the participants and the remainder is kept in a bank to which all payments indicated in the weight cards and the playing board are made unless the contrary indication appears.

In accordance with a preferred embodiment of the invention there is also provided in plurality of loan coards identified as such which represent moneny that a participant borrows from the bank and which otherwise have all of the attributes of currency.

The weight total of each of the participants is recorded in a current manner on miniature bathroom scale 109. The scales have a selector which can selectively be positioned to indicate 1 lb. intervals between zero lbs. and 65 lbs.

The procedure and rules for playing the game described hereinabove will now be set forth.

Each participant, hereinafter referred to as a dieter, is considered to begin the game in the condition of being 25 lbs. overweight. Thus the scale 109 associated with each participant is set initially at 25. The playing pieces are assembled at the Start location 105. One of the players or a fifth participant is nominated to be in charge of the bank and of the scoring scales 109 of the active pariticipants.

Three hundred dollars in game money is distributed to each of the four participants. Participants choose their playing piece and the color indicated thereon by a throw of dice 107 or the use of any other suitable chance generating means.

In accordance with an embodiment of the invention the following exclusion rules are established. Red and green dieters cannot visit the Sanatorium and the blue and yellow dieters cannot visit the Health Farm. The effect of this rule is that a dieter landing on a location which he is excluded from "entering" is not presented with any of the selectable options otherwise available to a participant whose piece lands thereon. Where a dieter is excluded for entering a "location" he must throw the dice again and move on.

Movement around the board is in a clockwise manner beginning at the start location and the amount of squares moved by a playing piece is indicated by a throw of a pair of dice 107 or by use of any other manually manipulable means bearing indicia for making a chance selection.

Each square, including the unnumbered squares, counts as one move.

A dieter whose playing piece lands on a square of color identical to the dominant color of the playing piece loses 2 lbs. while a dieter whose playing piece lands on a colored location whose color differs from that of the playing piece loses 1 lbs.

If the playing piece of a dieter arrives at either of locations 116 and 124 when another playing piece is already there both playing pieces move to location 120. If the playing piece of one dieter arrives at location 120 when another playing piece is already there, both playing pieces move to location 122.

If two playing pieces are simultaneously present at location 126 both playing pieces are returned to location 110.

For each 10 lbs. that a dieter loses he is awarded another 1 lbs. loss as a bonus.

In the event that a dieter exhaust his supply of game money he is permitted to borrow $50 in load cards from the bank. He need not return the $50 until he has $100 in his possession. The total amount of credit allowed to each dieter is $250.

If a dieter has reached his credit limit and has exhausted his supply of game money, nevertheless he is permitted to recieve a further $150 in return for a weight gain of 10 lbs. A dieter can follow this procedure only once in a game.

Weight cards are drawn from the top of the stack and replaced at the bottom thereof.

A first dieter to reduce to zero is the winner. A dieter that reaches 65 lbs. is forced to drop out of the game.

In accordance with an alternative embodiment of the invention four participants may be divided into pairs whose members are permitted to lend or give currency to each other. To win one of the members of a pair must lose 25 lbs.

It will be appreciated by those familiar with the art that the game described hereinabove is not limited to playing according to the above described set of rules but may be played with any suitable set of rules or procedures. Furthermore it is appreciated that rules may be devised for the game which may or may not incorporate the use of game money or loan cards. Furthermore game money may be replaced by any type of exchangeable media such as, for example, "AID IN DIETING" cards.

In summary, it will be appreciated that the game described above is not limited to the specific embodiment shown and described hereinabove but rather is defined only by the claims which follow.

I claim:

1. Dieting game board apparatus adapted to be played by a plurality of players operating in turn, the apparatus comprising a combination of:

manually manipulable means bearing indicia for making a chance selection;

a plurality of playing pieces each representing a dieter;

simulated weight indication means corresponding to each playing piece and functioning as a scoring device;

a playing board having a playing surface defined on a base surface thereof;

a series of playing locations defined about the perimeter of said playing surface in substantially contiguous relationship comprising a playing path along which said playing pieces are moved in discrete steps between successive locations as indicated by said manually manipulable means, said series of playing locations comprising;

a first plurality of locations indicating that a player whose piece lands thereon is to gain weight; and a second plurality of locations indicating that a player whose piece lands thereon is to lose weight.

2. Dieting game board apparatus according to claim 1 and also comprising a supply of game money.

3. Dieting game board apparatus according to claim 2 wherein said first plurality of locations includes at least one location indicating that a player whose piece lands thereon is to gain weight in return for a relatively large amount of money and at least one location indicating that a player whose piece lands thereon is to gain weight in return for relatively small amount of money.

4. Dieting game board apparatus according to claim 2 wherein said second plurality of locations comprises at least one first location indicating that a player whose piece lands thereon may lose a relatively large amount of weight in return for a relatively large payment of money and at least one secnd location indicating that a player whose piece lands thereon may lose a relatively small amount of weight in return for a relatively small amount of money.

5. Dieting game apparatus according to claim 4 wherein said at least one second location provides an electable opportunity to a player whose piece lands thereon to lose a relatively large amount of weight for a relatively large payment of money or to lose no weight for no money payment.

6. Dieting game board apparatus according to claim 1 wherein said weight indicating means comprises a miniature simulated bathroom scale.

7. A dieting game board apparatus adapted to be played by a plurality of players operating in turn, the apparatus comprising a combination of:

manually manipulable means bearing indicia for making a chance selection.

a plurality of playing pieces, each representing a dieter;

simulated weight indicating means corresponding to each playing piece and functioning as scoring device;

a supply of game money initially distributed at least in part of each player;

a plurality of weight cards containing player directions;

a flat generally rectangular shaped playing board having a playing surface defined on a base surface thereof;

a series of playing locations defined about the perimeter of said playing surface in substantially contiguous relationship to define a playing path along which said playing pieces are moved in discrete steps between successive locations as indicated by said manually manipulable means, the series of playing locations comprising:

at least one location providing an electable opportunity to a player whose piece lands thereon to lose a relatively large amount of weight in return for payment of a relatively large amount of game money;

at least one location indicating that a player whose piece lands thereon is to gain a relatively small amount of weight in return for an amount of money;

at least one location which indicates that a player whose piece lands thereon is to lose a relatively small amount of weight in return for a relatively small amount of money;

at least one location which indicates that a player whose piece lands thereon is to gain a relatively small amount of weight;

at least one location which indicates that a player whose piece lands thereon is to take one of the weight cards and to be directed by the directions contained thereon.

* * * * *